US010549317B2

(12) United States Patent
Benedetti

(10) Patent No.: US 10,549,317 B2
(45) Date of Patent: Feb. 4, 2020

(54) APPARATUS FOR TREATING HORTICULTURAL PRODUCTS, SUCH AS BLUEBERRIES AND THE LIKE

(71) Applicant: UNITEC S.P.A., Lugo (IT)

(72) Inventor: Luca Benedetti, Ravenna (IT)

(73) Assignee: UNITEC S.P.A., Lugo (IT)

( * ) Notice: Subject to any disclaimer, the term of this patent is extended or adjusted under 35 U.S.C. 154(b) by 0 days.

(21) Appl. No.: 16/078,862

(22) PCT Filed: Feb. 22, 2017

(86) PCT No.: PCT/EP2017/054066
§ 371 (c)(1),
(2) Date: Aug. 22, 2018

(87) PCT Pub. No.: WO2017/144534
PCT Pub. Date: Aug. 31, 2017

(65) Prior Publication Data

US 2019/0054503 A1 Feb. 21, 2019

(30) Foreign Application Priority Data

Feb. 24, 2016 (IT) ..... 102016000018806

(51) Int. Cl.
*B07C 5/342* (2006.01)
*B07C 5/02* (2006.01)
*B07C 5/36* (2006.01)

(52) U.S. Cl.
CPC ..... *B07C 5/342* (2013.01); *B07C 5/02* (2013.01); *B07C 5/368* (2013.01); *B07C 2501/009* (2013.01)

(58) Field of Classification Search
CPC ..... B07C 5/02; B07C 5/342; B07C 5/368
(Continued)

(56) References Cited

U.S. PATENT DOCUMENTS 4,273,649 A * 6/1981 Leverett ..... B07C 5/18 198/604
5,908,117 A * 6/1999 Stroman ..... B07C 5/02 198/850

(Continued)

FOREIGN PATENT DOCUMENTS

CL 2018002419 A1 12/2018
FR 2976195 A1 12/2012
FR 2976195 A1 * 12/2012 ..... B65G 47/682

OTHER PUBLICATIONS

International Search Report dated Apr. 26, 2017 re: Application No. PCT/EP2017/054066, pp. 1-3, citing: FR 2 976 195 A1.

(Continued)

*Primary Examiner* — Terrell H Matthews
(74) *Attorney, Agent, or Firm* — Cantor Colburn LLP

(57) ABSTRACT

An apparatus for treating horticultural products, such as blueberries and the like, includes in series at least one station for loading the horticultural products, at least one preliminary checking station, at least one alignment station, for their subsequent advancement aligned on at least one row, at least one viewing station, for acquiring information related to at least one parameter of interest of each horticultural product, such as the color, size, shape, sugar content, defectiveness, and the like, at least one distribution station for sorting the products into uniform subgroups as a function of the information acquired by the viewing station, and at least one recirculation apparatus for returning, at least to the viewing station, any horticultural products that have not been sorted by the distribution station.

11 Claims, 7 Drawing Sheets

(58) Field of Classification Search
USPC ..... 209/539
See application file for complete search history.

(56) References Cited

U.S. PATENT DOCUMENTS

| | | | | |
|---|---|---|---|---|
| 6,060,677 | A * | 5/2000 | Ulrichsen | B07C 5/342 209/577 |
| 8,714,362 | B2 * | 5/2014 | Jones | B07C 5/02 209/245 |
| 2013/0313169 | A1 * | 11/2013 | Lapeyre | B07C 5/38 209/546 |
| 2019/0047023 | A1 | 2/2019 | Benedetti | |

OTHER PUBLICATIONS

Written Opinion dated Apr. 26, 2017 re: Application No. PCT/EP2017/054066, pp. 1-4, citing: FR 2 976 195 A1.

* cited by examiner

APPARATUS FOR TREATING HORTICULTURAL PRODUCTS, SUCH AS BLUEBERRIES AND THE LIKE

TECHNICAL FIELD

The present disclosure relates to an apparatus for treating horticultural products, such as blueberries and the like.

BACKGROUND

Currently, industrial processes have an ever increasing level of automation, since only by entrusting to machines and robots the execution of the various steps of the treatment and processing of raw materials and of intermediate products is it possible to meet market demands.

In various fields of application, in fact, the market is now very large and at the same time is composed of highly demanding clients (in terms of costs and quality): automation allows to combine the various requirements, providing on a large scale and at modest costs products that comply with the required quality standards.

This situation is certainly shared by the food industry as well: in even greater detail, companies that process and distribute horticultural products on an industrial scale indeed resort to automated apparatuses and lines to handle, check, grade, package and more generally treat said horticultural products. According to known methods, some of these apparatuses are fed, at a loading station, with unsorted masses of a specific fruit (or other horticultural product), which often arrive directly from the fields.

In the loading section, adequate handling systems then transfer the products to the subsequent stations.

In greater detail, after undergoing some preliminary checks, the products are subjected one by one to the action of video cameras or similar vision systems, which analyze them and, by means of adapted software, check for each one of them the value assumed by one or more parameters of interest, such as for example color, shape and size, sugar content, ripeness, any rotting, etc.

Downstream of the video cameras, each product is then moved along a subsequent portion, which is affected by a plurality of unloading devices, which are arranged in sequence and can be operated in a mutually independent manner.

Each device faces or in any case is functionally associated with a respective collection container: for each fruit it is thus possible to activate the device that corresponds to the container in which one wishes to place it.

In this sense, the choice is indeed made as a function of the values assumed by the parameters of interest: uniform products, to be destined to packaging and distribution or to further processing steps, thus accumulate in each container.

The general structure thus outlined is adopted frequently particularly for small fruits such as cherries or blueberries, but it has drawbacks.

The check performed by the video cameras is in fact not free from problems that are not easy to solve: the great variety with which these products appear to the video cameras, as well as the variability of the surrounding (environmental) conditions in which the readings are made, sometimes prevents the correct detection of the parameters of interest, also due to technical limitations of the video cameras themselves and/or of the analysis software that has the task of processing the acquired images.

Known apparatuses therefore have adapted devices, arranged downstream of the video cameras, which retrieve the fruits for which reading is not performed, sending them back to the upstream stations, in practice subjecting them to a new cycle (trusting that the error will not reoccur).

Even in the presence of these devices, when the reprocessed fruits exceed a minimum (tolerable) threshold, as occurs for example when an unwanted negative drift in the operation of the video cameras occurs, a highly unwanted reduction of overall productivity is obtained.

The number of products delivered to the collection containers in the unit time is in fact reduced significantly, since many of the fruits initially loaded upstream are subjected to at least two treatment cycles before they are indeed delivered to the collection containers.

However, since this is an automated operation, these negative drafts are not detected promptly and the apparatus can thus operate even for a long time in non-optimal conditions.

The automated operation of the recirculation apparatus in fact allows to avoid rejects and the risk that products that are not distributed correctly end up in areas of the apparatus that are not dedicated to them, but at the same time keeps said apparatus operational even when malfunctions of the video cameras or of other stations cause low productivity, which is obviously unwelcome.

Moreover, it should be noted that in extreme conditions an excessive number of untreated fruits, due indeed to a malfunction of the upstream stations, may sometimes exceed the capacity of the recirculation apparatus, causing jamming and/or deterioration of the fruits.

These inconveniences are even more unwelcome indeed when these apparatuses or lines are designed for the treatment of blueberries.

Blueberries are in fact a substantially valuable fruit, due to their lower availability in nature, which contrasts with a high appreciation by customers, and therefore cost containment (obviously associated with the productivity of the corresponding processing line) is crucial in order to be able to offer in any case the product to the public at competitive costs, at the same time maintaining an adequate profit margin.

At the same time, this is a highly delicate fruit, which requires great care in its handling in order to avoid subjecting it to impacts: all reprocessing is therefore preferably to be avoided, indeed to reduce the risk of damaging it.

SUMMARY

The aim of the present disclosure is to solve the problems described above, by providing an apparatus for treating blueberries and similar horticultural products that is capable of detecting promptly a negative drift in the operation of the video cameras assigned to viewing the blueberries.

Within this aim, the disclosure provides a treatment apparatus that is capable of promptly detecting productivity drops caused by non-optimal operation of the video cameras.

The disclosure also provides an apparatus that allows to reduce the number of horticultural products subjected to reprocessing.

The disclosure further provides an apparatus that ensures high reliability in operation and can be obtained easily starting from commonly commercially available elements and materials.

The disclosure proposes an apparatus that adopts a technical and structural architecture that is alternative to those of apparatuses of the known type.

The disclosure also provides an apparatus that has modest costs and is safe in application.

This aim and these and other objects that will become better apparent hereinafter are achieved by an apparatus for treating horticultural products, such as blueberries and the like, comprising in series at least one station for loading the horticultural products, at least one preliminary checking station, at least one alignment station, for their subsequent advancement aligned on at least one row, at least one viewing station, for acquiring information related to at least one parameter of interest of each horticultural product, such as the color, size, shape, sugar content, defectiveness, and the like, at least one distribution station, for sorting the products into uniform subgroups, as a function of the information acquired by said viewing station, and at least one recirculation apparatus, for returning, at least to said viewing station, any horticultural products that have not been sorted by said distribution station, characterized in that it comprises at least one sensor for detecting any presence of horticultural products, which is arranged downstream of said distribution station along a transit line of said products, which leads to said recirculation apparatus, said at least one detection sensor being associated with at least one electronic control and management unit, which is provided with at least one module for counting the number of detected horticultural products.

BRIEF DESCRIPTION OF THE DRAWINGS

Further characteristics and advantages of the disclosure will become better apparent from the description of a preferred but not exclusive embodiment of the apparatus according to the disclosure, illustrated by way of nonlimiting example in the accompanying drawings, wherein.

DETAILED DESCRIPTION OF THE DRAWINGS

Figure 1:
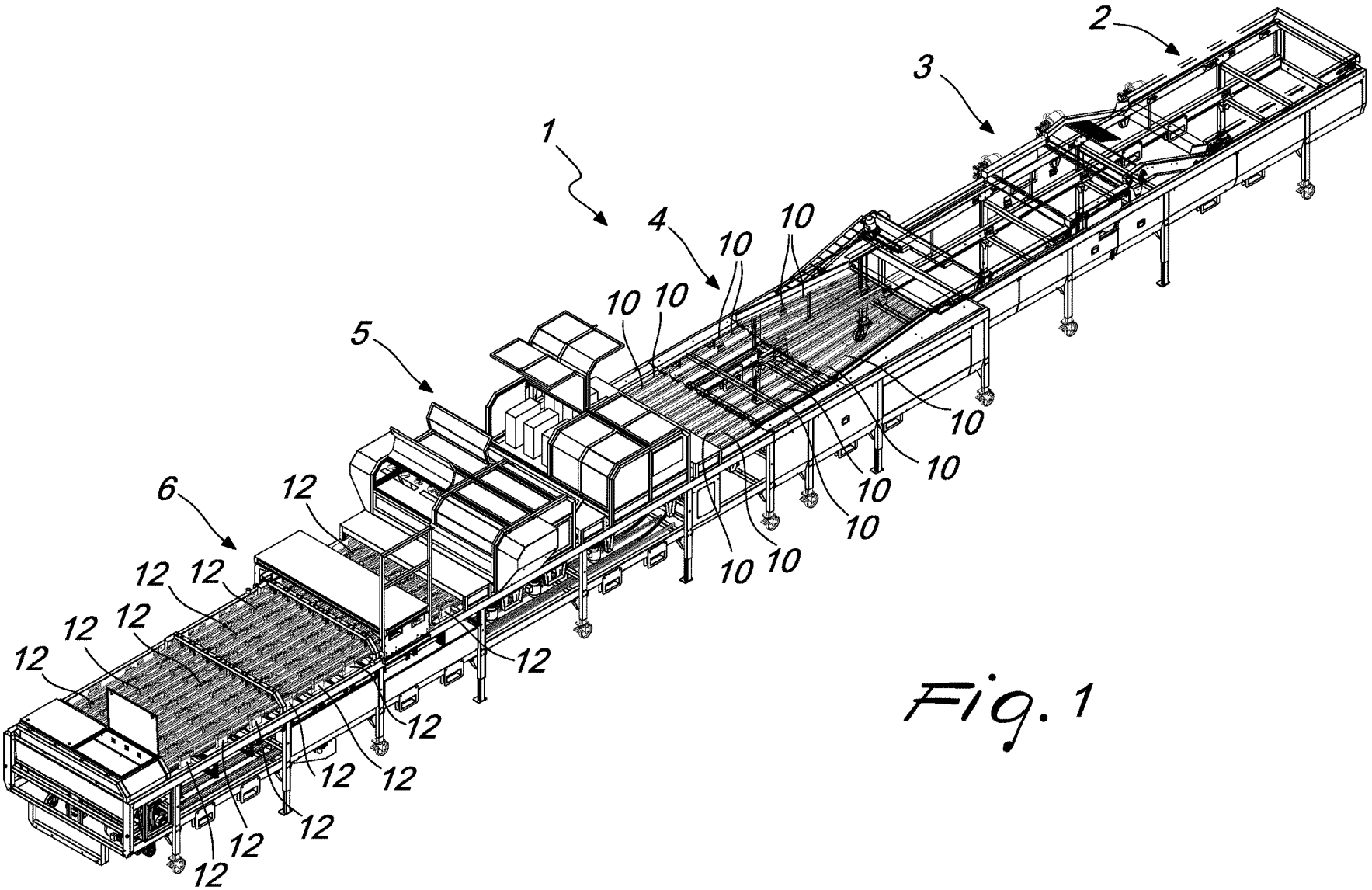
FIG. 1 is a lateral rear perspective view of the apparatus according to the disclosure.

With particular reference to FIGS. 1-9, the reference numeral 1 generally designates an apparatus for treating horticultural products A, of the type of blueberries and the like.

In greater detail, it is specified from the outset that in the preferred application of the disclosure, to which reference will be made often in the continuation of the present description and which highlights the particularities of said disclosure, the horticultural products A are indeed blueberries.

Likewise, use of the apparatus 1 for similar horticultural products A, such as cherries, strawberries, blackberries or raspberries, or others, as a function of specific practical requirements, is also provided.

Therefore, it is useful to specify that any specific reference to blueberries that will be made in the pages that follow is to be understood as extended also to any other horticultural product A.

Figure 2:
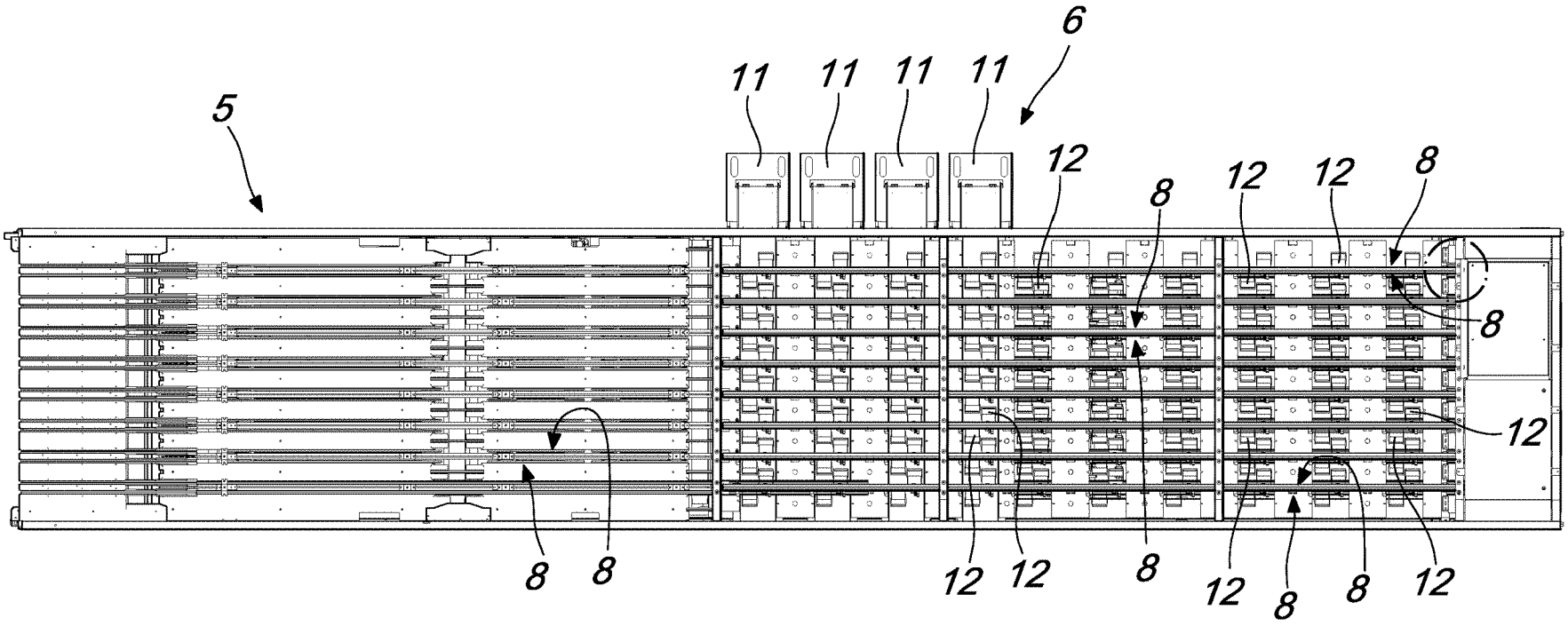
FIG. 2 is a top view of an end portion of the apparatus of FIG. 1.
Figure 3:
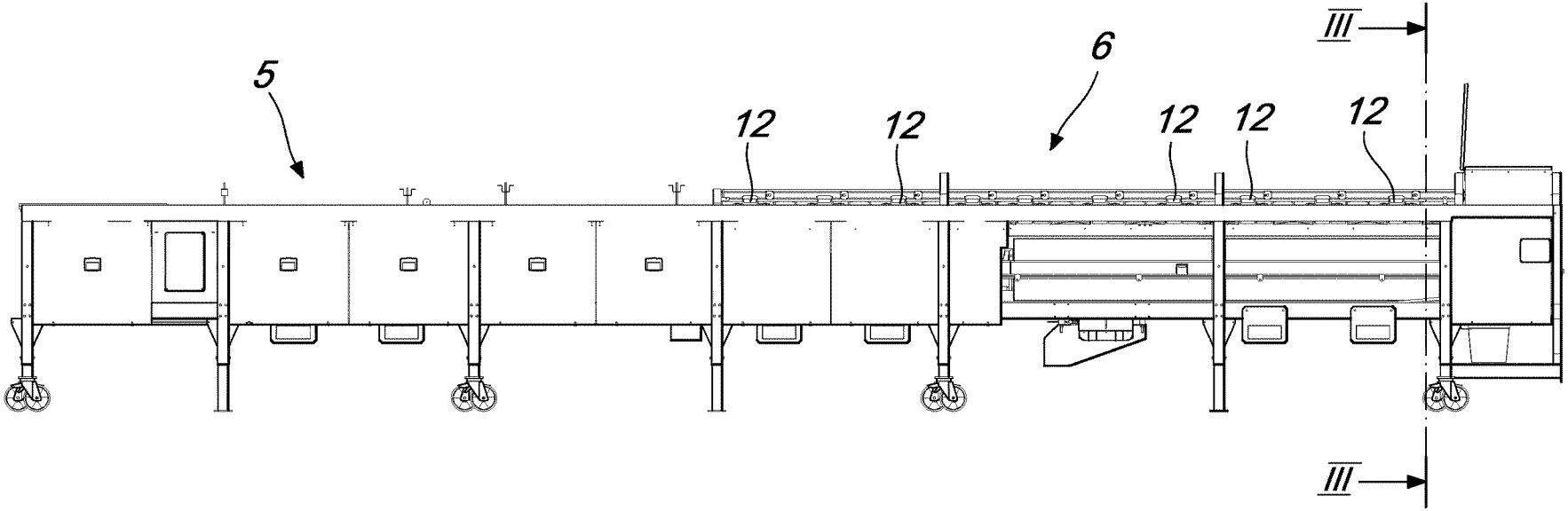
FIG. 3 is a front view of the portion of FIG. 2.
Figure 4:
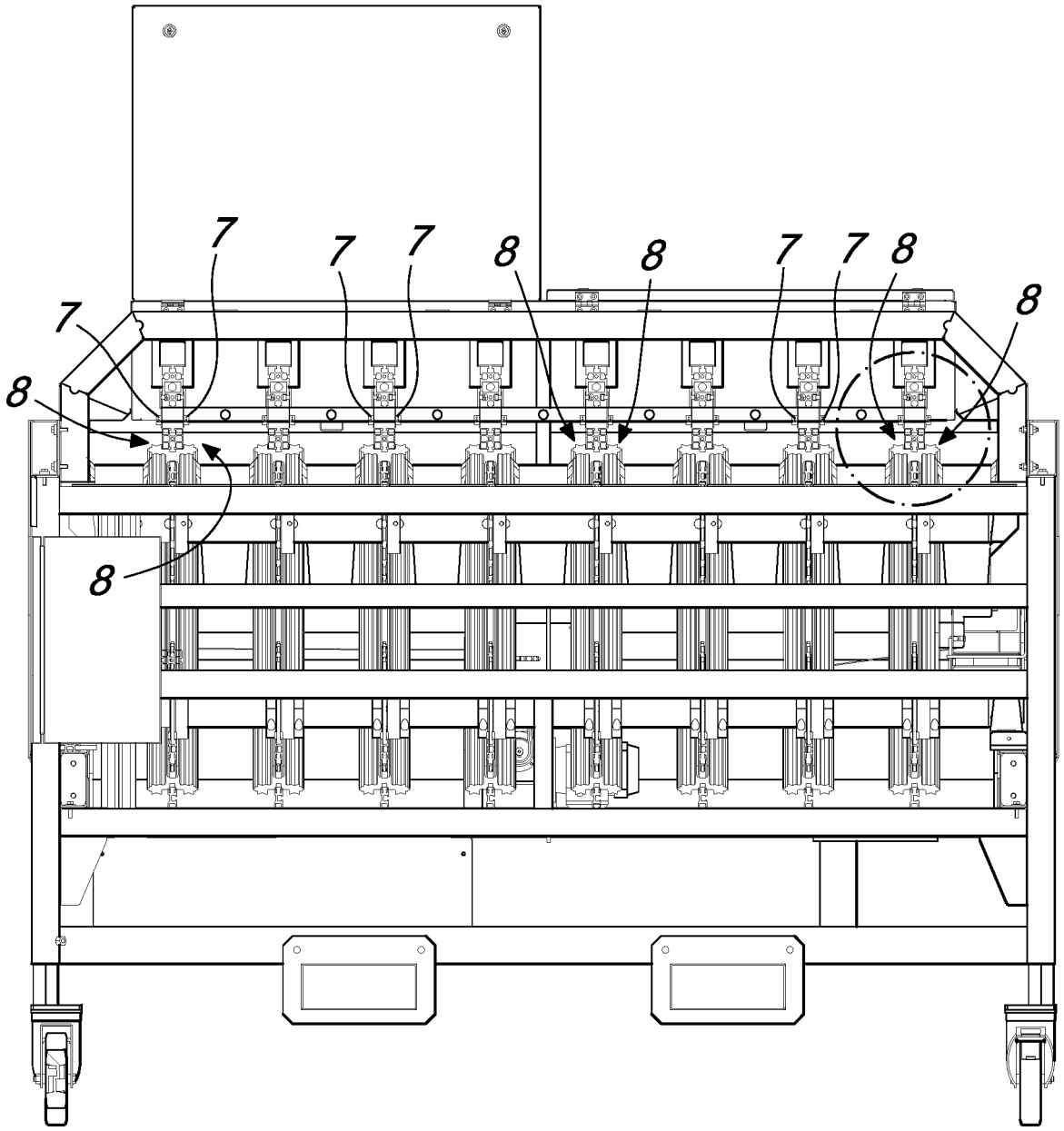
FIG. 4 is a sectional view of FIG. 3, taken along the line IV-IV.
Figure 5:
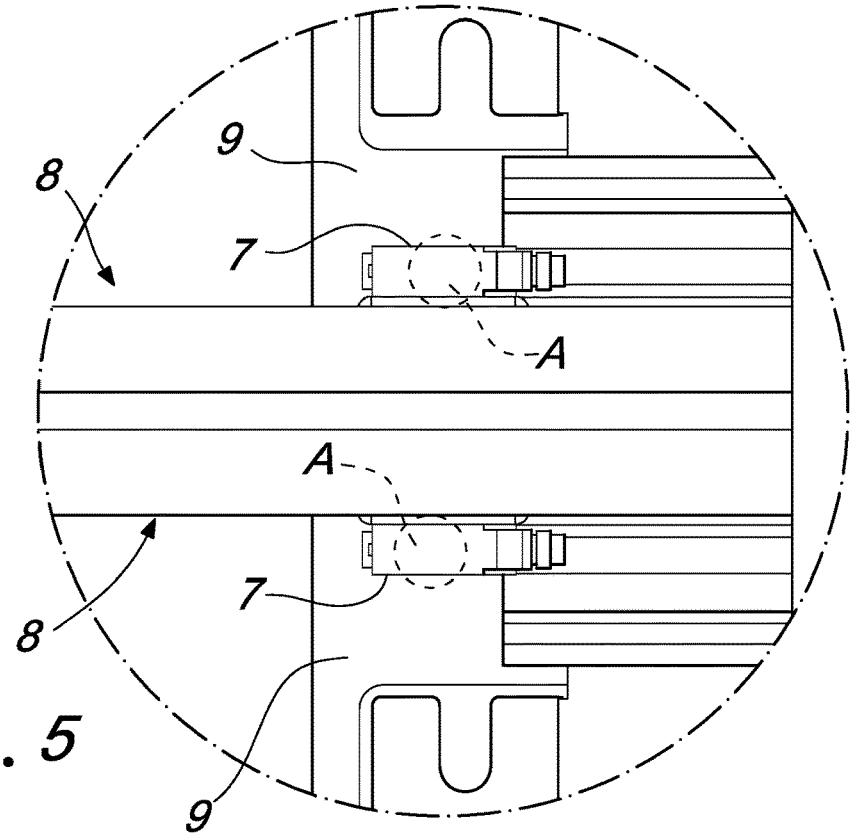
FIG. 5 is a highly enlarged-scale view of a detail of FIG. 2.

The apparatus 1 comprises in series at least one station 2 for loading the horticultural products A, at least one preliminary checking station 3, at least one alignment station 4, at least one viewing station 5 and at least one distribution station 6 (in FIG. 1, they are arranged from right to left, whereas in FIGS. 2 and 3 the viewing station 5 and the distribution station 6 are arranged from left to right).

In the loading station 2 the blueberries can be loaded in various manners and can be for example transferred or tipped (manually or by means of adapted devices) from crates filled loosely with these fruits (and which typically arrive directly from the picking fields).

At the loading station 2 the blueberries are then affected by adequate handling systems, which transfer them downstream: for example, at least in the first processing steps, the conveyance of the blueberries can be entrusted to one or more conveyor belts.

After the loading station 2, therefore, in the preliminary checking station 3 the blueberries are usually viewed by assigned workers, who remove the ones that evidently do not meet the desired quality criteria (for example because they are evidently defective or rotten) and/or any debris (leaves, twigs, etc.), which sometimes are conveyed together with the crates from the fields.

Furthermore, filters, traps (ducts of predefined width) or similar solutions are usually provided in the checking station 3 and automatically retain the products A that one does not wish to process, again because they are outside of the set criteria.

The alignment station 4 instead has the task of reorganizing the flow of blueberries (for example according to the methods that will be described for the preferred embodiment, which is not exclusive) so as to then make them advance in a queue on at least one line, as is necessary for the correct operation of the downstream sections.

Information related to at least one parameter of interest of each horticultural product A is then acquired in the viewing station 5. This parameter can be for example (but not exclusively) of the type of color, size, shape, sugar content, defectiveness, and the like.

Subsequently, and indeed as a function of the information acquired by the viewing station 5, the distribution station 6 sorts the products A into subgroups which are uniform (i.e., each of which has the same or similar values of one or more parameters of interest).

Downstream of the distribution station 6, any horticultural products A that are not sorted by said station are picked up by a recirculation apparatus, which in various manners sends them back at least to the viewing station 5.

These products A are in fact typically the ones for which a malfunction of the viewing station 5 has made it impossible to detect the information of interest. When this occurs, the distribution station 6 is evidently unable to assign the product A to the correct subgroup: the recirculation apparatus therefore allows the viewing station 5 to perform the check again and, trusting that the error will not reoccur, "recover" the horticultural product A, sending it in a correct manner, in a second cycle, to the final steps.

According to the disclosure, the apparatus 1 comprises at least one sensor 7 for detecting any presence of horticultural products A, which is arranged downstream of the distribution station 6 along a transit line 8 of the products A, which leads to the recirculation apparatus.

The detection sensor 7 (or each detection sensor 7, as will become better apparent hereinafter), is associated with at least one electronic control and management unit, which is provided with at least one module for counting the number of detected horticultural products A.

The electronic unit can be of any kind, and can be for example a controller or an electronic computer; typically, this is the same electronic element that controls the operation of the entire apparatus 1, but the provision of a device that is dedicated only to counting the fruits is not excluded.

It should be noted that the particular choice of resorting to at least one detection sensor 7, associated with an electronic control and management unit (which is preferably but not exclusively centralized), allows to achieve from the outset the intended aims and advantages. This choice in fact allows to keep constantly monitored the number of blueberries for which, for some reason, the viewing station 5 has been unable to acquire the information of interest, activating the adequate countermeasures when the number exceeds a tolerable limit.

In particular, although other possible constructive solutions are not excluded, the detection sensor 7 is chosen from a proximity sensor and an optical sensor.

Therefore, for example, the detection sensor 7 can be of the type of a proximity sensor that is inductive, capacitive, magnetic, ultrasonic, optical, etc., as a function of the specific requirements.

As an alternative, the detection sensor 7 can indeed implement one of the various known technologies for optical sensors, again as a function of the specific requirements.

In the preferred constructive solution, the detection sensor 7 is a photoelectric sensor, which is also known as photocell.

More particularly, and with further reference to the preferred constructive solution, the photoelectric sensor comprises a first emitter of a first beam of light, which lies above the transit line 8 and is normally directed toward a first receiver in order to detect any variation or interruption of the first beam, which indeed corresponds to the passage of a horticultural product A.

It is useful to specify that the protection is understood to be extended to a first beam composed of any type of light radiation, be it composed of visible light, infrared light, laser light, or others, and also to any type of photoelectric sensor (reflex reflector, reflective, barrier, etc.).

In any case, in order to ensure optimum operation of the photoelectric sensor (or other detection sensor 7), below the transit line 8 there is a black reference surface 9, which is arranged opposite the first emitter (and is indicated for the sake of simplicity only in FIG. 6).

Usefully, the electronic unit is provided with a module for constant (continuous or in any case periodic) comparison of the number of horticultural products A detected by the detection sensor 7 over predefined time intervals with a preset threshold.

Thus, when the counted number exceeds the threshold, indicating a negative drift of the operation of the viewing station 5, the electronic unit can promptly send an alarm signal, optionally stopping the apparatus 1 and in any case allowing rapid intervention of the operators, avoiding prolonged operation in conditions of low productivity.

The alarm signal can be of any kind, and therefore be constituted by an audio message, which can be heard clearly in the building, by a luminous message (the flashing of a lamp), by an information technology message conveyed toward the personal computer (or smartphone) of one or more operators, etc.

The threshold is therefore preferably chosen low enough to not allow significant and prolonged negative drifts of the operation of the viewing station 5 (and therefore high reductions in productivity); at the same time, preferably the threshold is chosen high enough to avoid sending alarm signals and/or machine stops for minimum quantities of reprocessed blueberries (due to small malfunctions of the viewing station 5), which would in any case cause an unwelcome reduction in productivity. The threshold is therefore chosen appropriately so as to combine the two mutually opposite requirements cited above.

It should be noted, however, that the number of blueberries counted by the detection sensors 7 can also be composed of blueberries for which the malfunction has occurred at the distribution station 6. The electronic control and management unit can, in this case, be programmed so as to emit a different alarm signal, when the information related to the parameters of interest have been properly acquired and nevertheless the blueberries have not been adequately sorted in the distribution station 6 (thus indeed indicating a malfunction of the latter and not of the viewing station 5).

Although it is noted that the apparatus 1 can be constituted by a single transit line 8, along which the blueberries advance one by one, in the preferred constructive solution, illustrated by way of nonlimiting example in the accompanying figures, the viewing station 5 and the distribution station 6 are crossed by a plurality of transit lines 8 (which are mutually parallel) of the horticultural products A, which are queued in corresponding lines by the alignment station 4.

Therefore, along each line 8 there is a respective detection sensor 7, which is arranged downstream of the distribution station 6.

Evidently, the choice to resort to a plurality of lines 8 allows to increase significantly the productivity of the apparatus 1 according to the disclosure.

In one embodiment of considerable practical interest, the alignment station 4 comprises at least one sequence of longitudinally aligned pairs of movable belts 10, which are arranged in a V-shaped arrangement and with a progressively decreasing center distance for the progressive queuing of the horticultural products A.

When the transit lines 8 are more than one (as in the accompanying figures), each line 8 is preceded by a respective sequence (for example three) of pairs of movable belts 10, so as to obtain a corresponding number of rows of blueberries queued one by one.

In the alignment station 4 the blueberries are then forced to cross in series the (progressively narrower) interspaces comprised between the pairs of movable belts 10: the mechanical action of the belts, which are indeed movable, causes the blueberries to automatically and progressively align themselves, even when they enter the interspaces in a side-by-side and not aligned configuration. In this sense, indeed the choice to resort to a sequence of pairs of movable belts 10, with a progressively decreasing center distance, allows a gradual alignment, in order to ensure the desired result in a manner that respects the integrity of the horticultural products A (and therefore without damage to them and avoiding any jamming).

In the preferred constructive solution, the viewing station 5 comprises at least one video camera (and preferably one for each line 8), which is associated with the electronic control and management unit, which in turn is provided (or even associated with an additional device that is provided) with software for the analysis of the images acquired by the video camera, in order to determine the information related to the already cited parameters of interest.

Advantageously, the distribution station 6 comprises a plurality of pressurized fluid dispensers, which are arranged in series along each transit line 8.

The dispensers can be activated selectively on command during the transit of each product A, preferably (but not exclusively) on the part of the control and management unit, as a function of information acquired by the viewing station 5.

Each dispenser is capable of sending a jet of the pressurized fluid toward the product A in order to obtain its consequent fall from a respective handling unit toward a corresponding collection container 11.

It should be noted, therefore, that sorting into uniform subgroups indeed occurs by virtue of the cooperation between the viewing station 5 and the distribution station 6, which is preferably controlled by the control and management unit.

In fact, for each blueberry in transit the control and management unit activates the dispenser arranged in a functional connection with the specific collection container 11 indeed designed to accommodate all and only the blueberries for which the parameters of interest assume given values.

The jet of compressed air causes the blueberries to fall from the respective handling unit, on which they rest and are conveyed along the line 8, thus directing them toward the underlying area, where they are received by transfer belts which indeed lead to respective containers 11 (or directly by the containers 11, if one chooses to arrange them below the line or lines 8).

In order to ensure optimal conveyance of the blueberries during the fall, a respective baffle 12 is arranged opposite each dispenser on the opposite side with respect to the corresponding transit line 8 and is designed to divert the horticultural products A that are struck by the jet.

Usefully, the recirculation apparatus in turn comprises at least one conveyor belt 13, which is functionally arranged downstream of the distribution station 6 and leads even indirectly to the viewing station 5.

The term "functional" arrangement indeed means that it performs its role on the blueberries after the distribution station 6 and that by virtue of its arrangement it can receive the horticultural products A that have not been sorted by the distribution station 6 and are delivered to it by an end portion of the transit line 8.

The accompanying figures show a solution in which the conveyor belt 13 is composed of a single straight portion which (downstream) is adjacent to the distribution station 6; in this solution, downstream of the conveyor belt 13 there is an additional auxiliary belt (not shown for the sake of simplicity), which runs parallel to the orientation along which the blueberries advance in the preceding steps, but in the opposite direction, indeed so as to return to the viewing station 5 the blueberries that have not been treated adequately.

Resorting to differently shaped conveyor belts 13, which may even cooperate with a number at will of auxiliary belts, is not excluded in any case.

Figure 6:
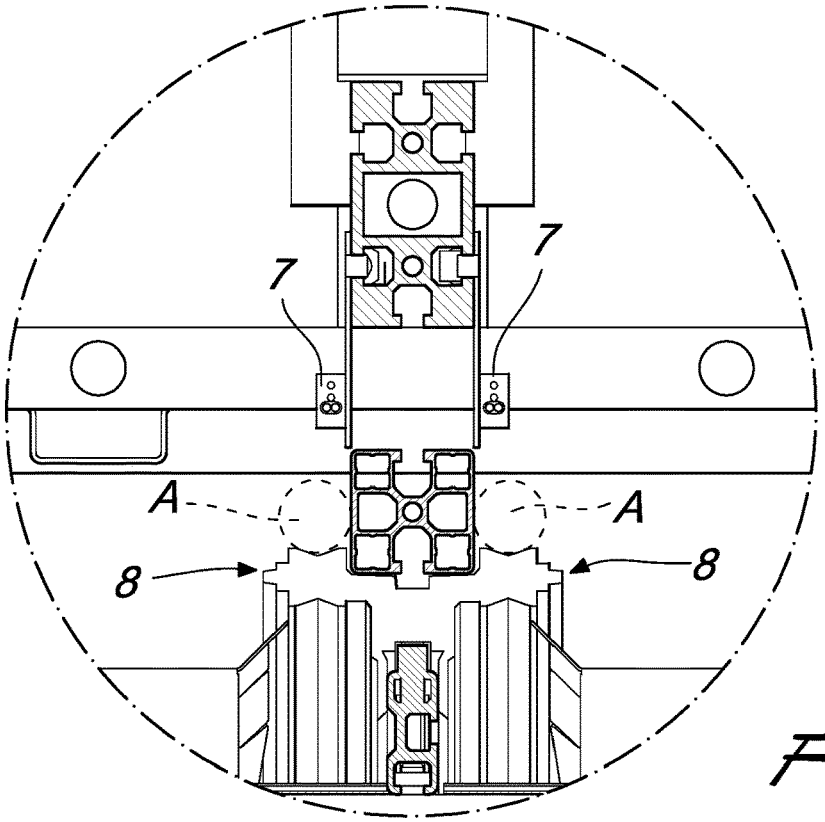
FIG. 6 is a highly enlarged-scale view of a detail of FIG. 4.
Figure 7:
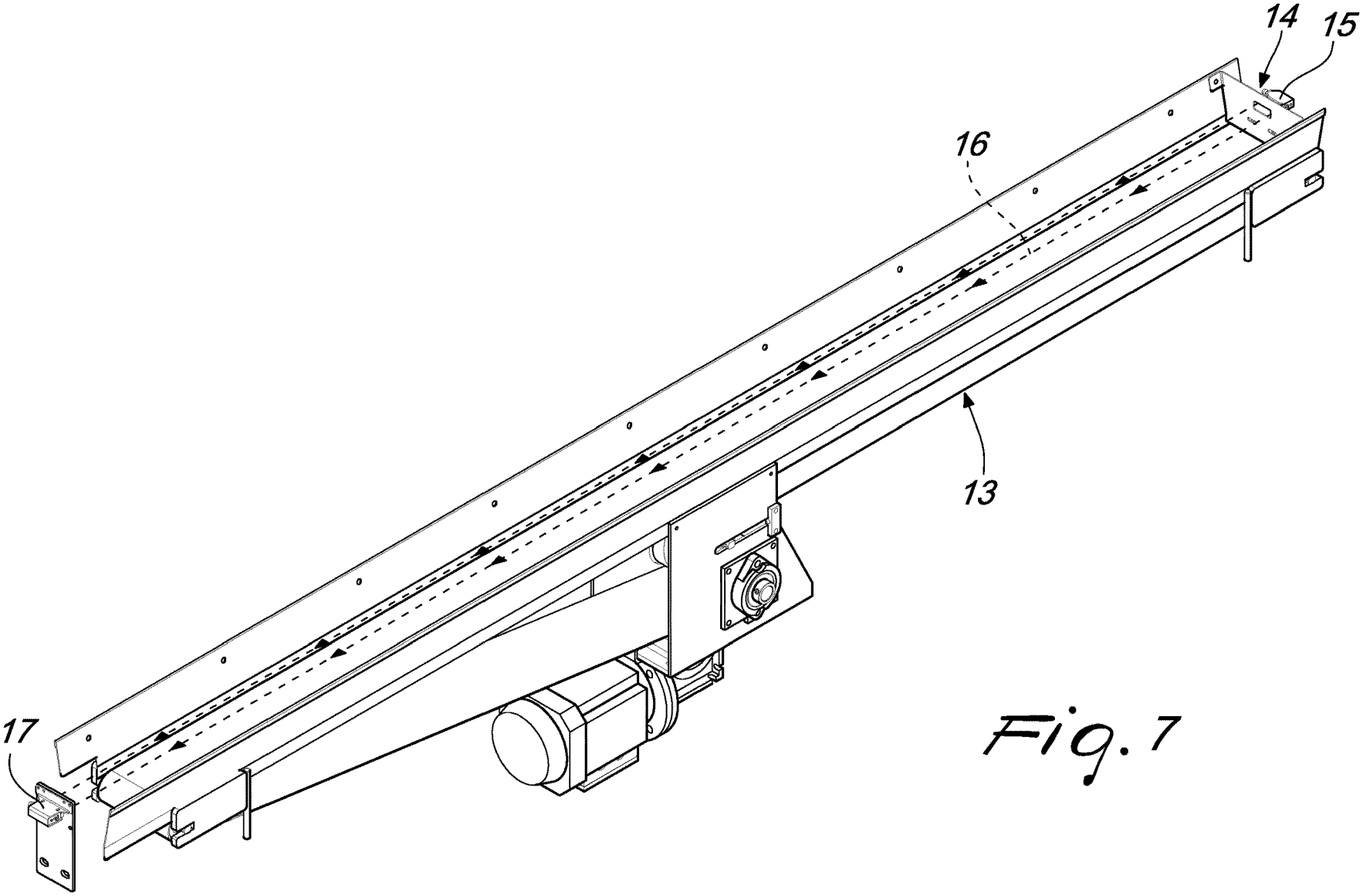
FIG. 7 is a perspective view of two components of the recirculation apparatus.
Figure 8:
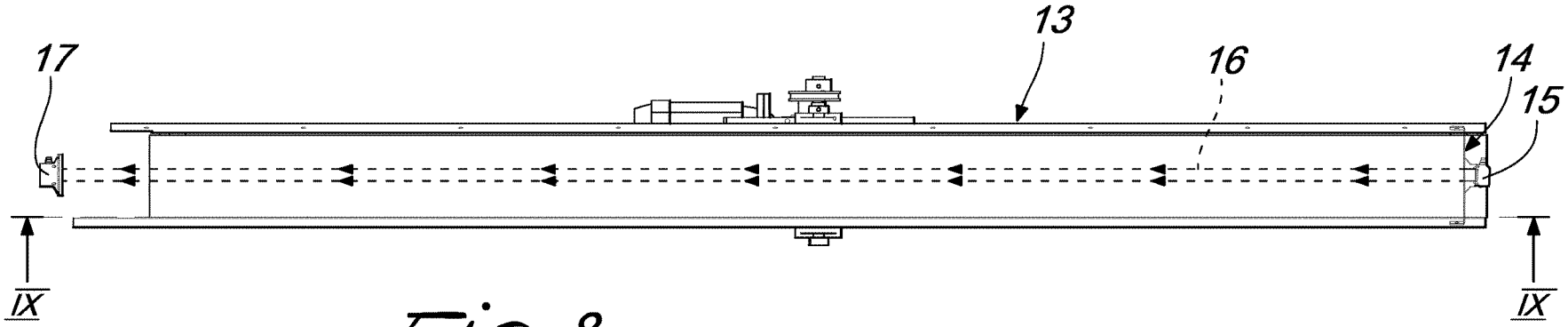
FIG. 8 is a top view of the components of FIG. 7.
Figure 9:
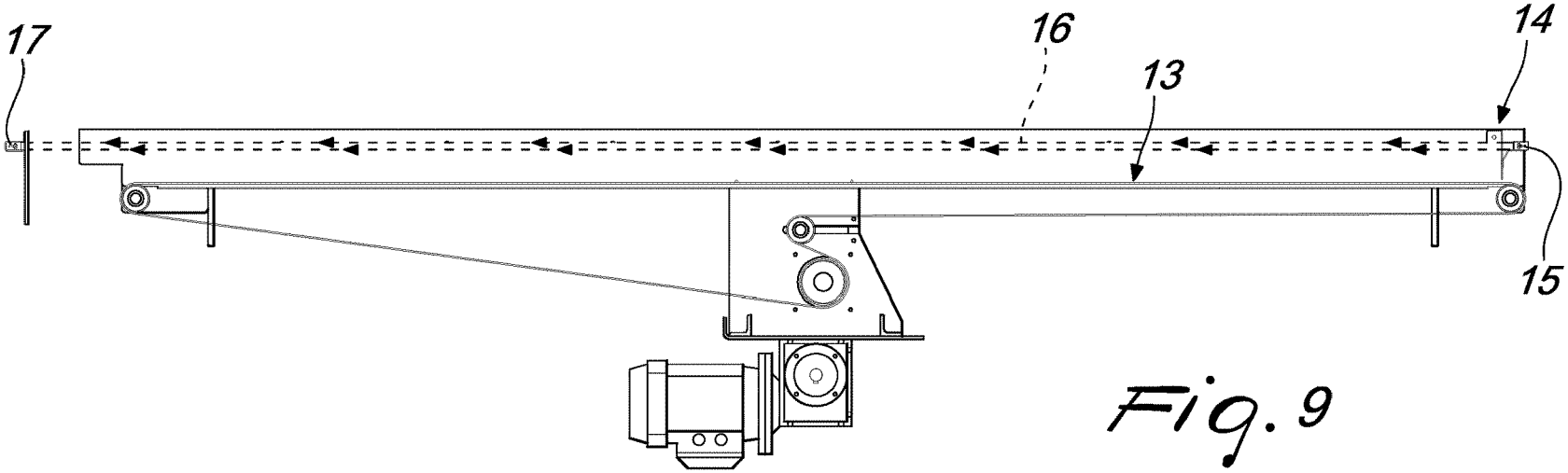
FIG. 9 is a sectional view of FIG. 8, taken along the line IX-IX.

Furthermore, as can be deduced from FIGS. 6 to 8, the recirculation apparatus comprises at least one sensor 14 for checking the transit of the horticultural products A above and at a predefined height with respect to the conveyor belt 13.

The height is appropriately chosen so as to correspond to a predefined limited value of products A, which are accumulated and in transit on the conveyor belt 13.

For example, therefore, the arrangement of the checking sensor 14 can be such as to give it the possibility to detect blueberries in transit at a height that is equal to a multiple of the average space occupation of the blueberries.

In optimum (or in any case acceptable) operating conditions, the blueberries are rested and conveyed only occasionally on the conveyor belt 13, and thus travel individually downstream and do not accumulate against each other, and therefore are not identified by the checking sensor 14. When instead a malfunction for which a significant number of blueberries is unloaded onto the conveyor belt 13 occurs upstream, such blueberries tend to accumulate against each other and therefore their presence is detected by the checking sensor 14, allowing the prompt activation of adequate countermeasures.

Likewise, the checking sensor 14 allows to activate prompt countermeasures also when the conveyor belt 13 itself is not operating correctly: if the latter is for some reason in a stopped condition (or is moving slower than intended), the blueberries again accumulate against each other, being promptly detected by the checking sensor 14.

Indeed to allow the activation of adequate countermeasures, the checking sensor 14 is associated with the electronic control and management unit.

As already noted for the detection sensor 7, the checking sensor 14 also can be of any kind as a function of the specific requirements. In the preferred solution, the checking sensor 14 is also a photoelectric sensor (a photocell), even of the type of the detection sensor 7, and comprises a second emitter 15 of a second beam of light 16, which is normally directed toward a respective second receiver 17.

The choice of the position of the second emitter 15 and of the second receiver 17 is made so as to ensure the crossing of an area that lies above at least a segment of the conveyor belt 13 on the part of the second beam of light 16.

Preferably, as indeed shown in the cited figures, the second emitter 15 and the second receiver 17 are aligned along the advancement direction of the horticultural products A that is defined by the conveyor belt 13. This solution is of extreme practical interest, since it allows to detect unwanted accumulations of blueberries in any point of the conveyor belt 13 with a single photocell.

The operation of the apparatus according to the disclosure is evident from what has been outlined so far: it has in fact already been shown that the blueberries are subjected to the action of a plurality of devices and stations 2, 3, 4, 5, 6, which cooperate to perform a plurality of automated activities on the products A, in order to deliver them to collection containers 11 in uniform subgroups (which lack impurities and rotten or otherwise defective products).

The presence of the detection sensors 7 allows to achieve the intended aim: by counting the blueberries that are still present along the lines 8, downstream of the distribution station 6, it is possible to identify promptly a negative drift in the operation of the video cameras assigned to viewing the blueberries, being thus able to intervene rapidly, avoiding the danger that the apparatus 1 might operate for a long time in conditions of limited productivity.

At the same time, the number of horticultural products subjected to reprocessing is thus reduced to the minimum tolerable value, since indeed the detection sensors 7 ensure the possibility to activate adequate countermeasures as soon as the number rises in an unwanted manner.

Therefore, the number of blueberries that are damaged or defective (due to the handling and treatments performed by the apparatus 1) is kept at negligible (or even nil) values.

From what has been observed above, one deduces therefore that usefully the apparatus 1 ensures high productivity and high quality levels, which are evidently appreciated in the treatment of any horticultural product A and even more in relation to valuable fruits, such as indeed blueberries.

The useful functionalities mentioned above, and the benefits that can be advantageously achieved by means of the detection sensors 7, are further increased in case of implementation of the checking sensor 14, which ensures an additional monitoring of the operating conditions of the upstream devices, such as for example the viewing station 5 and the distribution station 6 (as well as the conveyor belt 13 itself).

The disclosure thus conceived is susceptible of numerous modifications and variations; all the details may further be replaced with other technically equivalent elements.

In the exemplary embodiments shown, individual characteristics, given in relation to specific examples, may actually be interchanged with other different characteristics that exist in other exemplary embodiments.

In practice, the materials used, as well as the dimensions, may be any according to the requirements and the state of the art.

The disclosures in Italian Patent Application No. 102016000018806 (UB2016A001031) from which this application claims priority are incorporated herein by reference.

The invention claimed is:

1. An apparatus for treating horticultural products, the apparatus comprising in series at least one station for loading the horticultural products, at least one preliminary checking station, at least one alignment station for their subsequent advancement aligned on at least one row, at least one viewing station for acquiring information related to at least one parameter of interest of each horticultural product, at least one distribution station for sorting the products into uniform subgroups, as a function of the information acquired by said viewing station, and at least one recirculation apparatus for returning, at least to said viewing station, any horticultural products that have not been sorted by said at least one distribution station, further comprising at least one sensor for detecting any presence of horticultural products, which is arranged downstream of said at least one distribution station along a transit line of said products, which leads to said at least one recirculation apparatus, said at least one detection sensor being associated with at least one electronic control and management unit provided with at least one module for counting the number of detected horticultural products.

2. The apparatus according to claim 1, wherein said at least one detection sensor is chosen between a proximity sensor and an optical sensor.

3. The apparatus according to claim 1, wherein said at least one detection sensor is a photoelectric sensor.

4. The apparatus according to claim 3, wherein said photoelectric sensor comprises a first emitter of a first beam of light, which lies above said transit line and is normally directed toward a first receiver, to detect any variation or interruption of said first beam, which corresponds to the passage of a horticultural product, a black reference surface arranged opposite said first emitter being provided below said transit line.

5. The apparatus according to claim 1, wherein said electronic unit is provided with a module for a constant comparison of a number of horticultural products detected by said at least one detection sensor on predefined time intervals, with a preset threshold, for the timely sending of an alarm signal when said number exceeds said threshold.

6. The apparatus according to claim 1, wherein said viewing station and said distribution station are crossed by a plurality of said transit lines of the horticultural products, which are queued by said at least one alignment station, along each one of said lines, which are mutually parallel, there being a respective said at least one detection sensor arranged downstream of said distribution station.

7. The apparatus according to claim 1, wherein said at least one alignment station comprises at least one sequence of longitudinally aligned pairs of movable belts arranged in a V-like configuration with a progressively decreasing center distance for the progressive queuing of the horticultural products.

8. The apparatus according to claim 1, wherein said viewing station comprises at least one video camera associated with said electronic control and management unit, said unit being provided with software for the analysis of images acquired by said video camera in order to determine information related to said at least one parameter of interest.

9. The apparatus according to claim 1, wherein said at least one distribution station comprises a plurality of pressurized fluid dispensers arranged in series along said transit line and can be activated selectively on command during the transit of each product, by said control and management unit, as a function of the information acquired by said viewing station, in order to send a jet of the pressurized fluid toward the product and for its consequent fall, from a respective handling unit, toward a corresponding collection container, a respective baffle being arranged opposite each one of said dispensers, on an opposite side with respect to the corresponding said transit line, in order to divert the horticultural products struck by said jet and for an optimum conveyance of said horticultural products.

10. The apparatus according to claim 1, wherein said recirculation apparatus comprises at least one conveyor belt arranged functionally downstream of said at least one distribution station and leads even indirectly to said viewing station, said apparatus comprising at least one sensor for checking the transit of horticultural products above and at a predefined height, with respect to said at least one conveyor belt, said height being chosen so as to correspond to a predefined limit value of products that have been accumulated and are in transit on said conveyor belt.

11. The apparatus according to claim 10, wherein said at least one checking sensor is a photoelectric sensor and comprises a second emitter of a second beam of light that is normally directed toward a respective second receiver, said second beam of light passing through an area that lies above at least one segment of said at least one conveyor belt.

* * * * *